United States Patent [10]

Arendt

[11] 4,052,796

[45] Oct. 11, 1977

[54] PROCESS AND APPARATUS FOR THE CONTINUOUS FINISHING OF WEBS OF TEXTILES, ARTIFICIAL LEATHER AND THE LIKE

[76] Inventor: Hans F. Arendt, Bleichinsel, 712 Bietigheim, Germany

[21] Appl. No.: 616,090

[22] Filed: Sept. 23, 1975

Related U.S. Application Data

[63] Continuation-in-part of Ser. No. 400,911, Sept. 26, 1973, Pat. No. 3,938,356.

[30] Foreign Application Priority Data

Sept. 27, 1972 Germany ..... 2247320
Sept. 26, 1974 Germany ..... 2445915

[51] Int. Cl.[2] ..... F26B 13/12

[52] U.S. Cl. ..... 34/60; 34/155; 68/5 D; 68/20; 68/177

[58] Field of Search ..... 34/155, 159, 133, 135, 34/216, 217, 68, 61, 60, 157; 68/177, 178, 175, 5 D, 5 E, 20; 26/106, 81

[56] References Cited

U.S. PATENT DOCUMENTS

| | | | |
|---|---|---|---|
| 2,132,156 | 10/1938 | Gessner | 34/159 X |
| 2,431,372 | 11/1947 | Cook et al. | 68/5 D X |
| 2,456,301 | 12/1948 | Miller et al. | 34/159 X |
| 2,522,900 | 9/1950 | Schmitt | 68/5 D |
| 3,470,625 | 10/1969 | Chikamasa et al. | 34/159 X |
| 3,594,914 | 7/1971 | Kutsuki et al. | 34/60 X |
| 3,597,851 | 8/1971 | Arendt et al. | 34/60 |

FOREIGN PATENT DOCUMENTS

| | | | |
|---|---|---|---|
| 954,996 | 1/1950 | France | 68/177 |
| 1,954,571 | 5/1971 | Germany | 34/135 |
| 2,224,881 | 12/1973 | Germany | 34/155 |

*Primary Examiner*—William F. O'Dea
*Assistant Examiner*—Harold Joyce
*Attorney, Agent, or Firm*—Littlepage, Quaintance, Murphy, Richardson & Webner

[57] ABSTRACT

An apparatus for treating a web of material of indefinite length consists of a generally rectangular chamber having a single opening at the top and a screen arranged within the chamber to asymmetrically sag in a shape of approximately elliptical cross-section and means for introducing a web treatment medium into the chamber. This apparatus is advantageously combined with a flow-through reversible drum treatment chamber having within a casing a periodically reversed rotating drum through which a web of material is received in the relaxed state travelling continuously through the interior of the drum and means for controllably conditioning air and introducing the air into the drum. The apparatus can further consist of a casing enclosing a chamber containing a plurality of upper and lower rollers arranged within the casing such that the web of material traversing the chamber passes around the rollers in a vertical zig-zag path of loops with upper and lower distributor means positioned within the chamber for distributing diverse treatment media to preselected regions of the chamber and directing the diverse treatment media on preselected portions of the web. The apparatus is most advantageously used in the process of continuously finishing a web of material of indefinite length by wetting the web of material to a uniform moisture content of about 20–50%, heating the web, moving the web in a relaxed state through a rotating reversible drum and flattening the web to an easily transported shape.

3 Claims, 6 Drawing Figures

PROCESS AND APPARATUS FOR THE CONTINUOUS FINISHING OF WEBS OF TEXTILES, ARTIFICIAL LEATHER AND THE LIKE

CROSS REFERENCES TO RELATED APPLICATIONS

This application is a continuation-in-part of Ser. No. 400,911 now U.S. Pat. No. 3,938,356 filed Sept. 26, 1973 entitled Web Finishing Machines.

BACKGROUND OF THE INVENTION

1. Field of the Invention

This invention relates to a process for the continuous finishing of webs of textiles, artificial leather and the like by wetting the web, heating the web, and moving the web in a relaxed-state through a rotating reversible drum and the apparatus for carrying out this process. The apparatus is arranged for the continuous feed and discharge of a textile or other web into and out of a chamber respectively within which the web is treated with gas, steam, mist, or other treatment media to alter or refine the character and texture of the web being treated.

2. Description of the Prior Art

It is known in the prior art to crimp textilès of limited length by treating them in batch fashion in a heatable, rotatable drum. An apparatus suitable for carrying out such a batch process is to be found in U.S. Pat. No. 3,597,851. In the batch treatment, the material is wetted at the beginning of the treatment in the drum by injecting steam or water.

It is also known in the prior art to treat artificial leather continuously in a reversible continuous drum for the purposes of producing a surface grain, and subsequently to flatten the material again and roll it up. An example of such an apparatus is to be found in German Auslegeschrift No. 1,954,571.

In the applicant's earlier application, Ser. No. 400,911, filed Sept. 26, 1973 now U.S. Pat. No. 3,938,356, the applicant has also already proposed to pass a web of material, prior to the treatment in the continuous flow-through drum, over a pretreatment or conditioning section where the web of material is irradiated, steamed and/or sprayed, as well as possibly dried. In this process, it has proven difficult to give the material, before it enters the drum, the required moisture content. Particularly in the processing of dry material in the tensioned state, a uniform wetting is difficult to achieve. The material must therefore be super wetted or soaked for reasons of safety. For the predrying of the soaked material, however, a drying section of such length as renders the plant uneconomical is necessary. The material is therefore, regardless of the moisture content achieved in the pretreatment, usually super wetted before being introduced into the continuous flow-through drum for further treatment. Since the drying of the material is completed in the flow-through drum, the result of the aforementioned mode of operation is a large drop of moisture and specific weight in thhe material. The loops of material formed at the inlet end come to rest on top of the preceding, already dried, material thus leading to non-uniformity of the drying and spotty results and to the graining and texturing of the web of material.

SUMMARY OF THE INVENTION

Accordingly, it is an object of this invention to avoid these disadvantages by giving the material, prior to the treatment in the reversible flow-through drum, a moisture content of between 20 to 50 percent. This is preferably carried out by predrying and/or steaming of the material. In one embodiment the steaming is carried out in a relaxed state of the material while in another embodiment of the process a heating medium is used which is carried in a direction counter to that of the travel of the web of material. As yet a further possibility, it is proposed that hot air and steam be simultaneously applied to the web of material.

One apparatus for carrying out the process of the invention consists of a reversible continuous flow drum with a preceding conditioning section for treating a web of material in the tensioned-state. The tensioned-state web treatment apparatus comprises generally a rectangular casing enclosing a chamber, a plurality of upper and lower rollers arranged within the casing such that a web of material traversing the chamber passes around the rollers in a vertical zig-zag path of loops. The rollers are synchronously driven thus guiding the web of material in the zig-zag like fashion. Upper and lower distributor means positioned within the chamber distribute diverse treatment media to preselected regions of the chamber. Duct means standing upon and depending from the upper and lower distributor means respectively, project into selected loops in the zig-zag path of the web of material and direct the diverse treatment media on preselected portions of the web. In one embodiment of the apparatus an inlet for a heating medium is suitably provided at one end of the section by an aperture in a lower portion of one side of the casing. An outlet consisting of a second aperture permits the escape of the spent heating medium after having contacted at least a portion of the web material. The inlet aperture and the outlet aperture are so arranged that the path to the treatment medium is in a reverse direction to that of the path of the web of material being treated. The distributor means may be connected with drum ventilators or the like and may also be provided with an additional heating means. The distributor means is connected directly to the plate-like nozzle duct which inject the appropriate web treating medium between parallel layers of the web of material. The distributors can be connected to an external supply of steam for steaming the web of material.

In a selected embodiment, at least part of the upper and lower rollers are flattening rollers of a smaller diameter with a spiral configuration similar to that shown in U.S. Pat. No. 3,805,560.

For the treatment of a dry material, an embodiment of the apparatus is proposed wherein the preconditioning device is constructed as a relaxed-state web treatment chamber comprising a generally rectangular enclosure enclosing a chamber open at the top and provided with an asymmetrically sagging screen or grate arranged within the chamber to support the web while in the chamber. Two opposite walls of the chamber are preferably inwardly tapered toward the top and provided with suitable means for introducing and withdrawing the web of material to and from the treatment chamber through the single opening existing at the top of the chamber. The asymmetrically sagging screen functions as a bearing surface for supporting the web of material within the chamber. The screen preferably having an approximately elliptical cross-section has the deepest point suitably positioned more closely to an outlet side of the chamber.

The relaxed state web treatment chamber as previously described can be most advantageously used in combination with a flow-through reversible drum treatment chamber as disclosed in copending application Ser. No. 400,911, filed Sept. 26, 1973 now U.S. Pat. No. 3,938,356, which is hereby specifically incorporated by reference thereto. As a further suitable embodiment of an apparatus having particular utility for treatment of a web of material of indefinite length, an apparatus is proposed which contains a flow-through reversible drum treatment chamber, a relaxed state web treatment chamber, a tensioned-state web treatment chamber together with a web supply means for supplying a web of material of indefinite length and a web demand means for receiving the web from the flow-through reversible drum treatment chamber and depositing the web in an easily handled form.

Soaked material, that is, material which has been given a preceding treatment such as dyeing, sizing or the like or a simple wetting for the purpose of further treatment, having a moisture content of about 100% water, requires, for establishing the preferred moisture content of about 20 to 50 percent, a longer predrying. This predrying preferably takes place in the tensioned-state of the material since, in fact, the drying is completed in the drum and the crimping process can readily take its course in the drum treatment phase.

A tensioned-state conditioning section can also be advantageously used in the finishing of dry material in which it then proceeds into a relaxed-state treatment chamber for steaming to arrive at the preferred moisture content of between 20 and 50%. In this way a better distribution of moisture and heat is accomplished so that the super wetting or soaking of the material can be largely diminished or even avoided.

Of course, other additional treatment of the material such as selective irradiation can also be carried out as taught by the copending application Ser. No. 400,911 now U.S. Pat. No. 3,938,356 filed Sept. 26, 1973. This can be further combined with the conditioning of the dry material from the very beginning and avoiding the super wetting or soaking of the material by steaming the material in the relaxed-state. The material in this process is introduced into the relaxed-state web treatment chamber and, after a prespecified period of treatment, withdrawn therefrom and fed directly into the continuous flow-through reversible drum treatment chamber for further treatment therein.

Which method of treatment is chosen in each case depends on the kind of material involved as well as the effects sought to be achieved and the initial condition of the web of material. In general, the relaxed-state web treatment chamber will always be employed before the treatment in the flow-through reversible drum treatment chamber when a partial shrinking effect is to be achieved or when, as for example in the case of pile material, the contact between the surface and any conveying rollers is undesirable.

A combination of methods may be used such as in the dyeing with reactive dyestuffs. After the dyestuff has been applied a predrying is necessary which then may be followed with either a shrinking or crimping process as outlined herein.

The invention is further illustrated by the following examples. These non-limiting examples are illustrative of certain embodiments designed to teach those skilled in the art how to practice the invention and represent the best mode contemplated for carrying out the invention.

EXAMPLE 1

A light textured polyester woven material was steamed in the relaxed-state web treatment apparatus. The rate of passage was 15 meters per minute with approximately a 15 meter lead. Subsequently, the steaming was continued in the tensioned-state web treatment apparatus. The material then traversed through the flow-through reversible drum treatment apparatus and was dried at 100° C. with a material accumulation of about 50 meters. The crimping value of the material amounted to 15% with a residual crimping value of plus or minus one.

EXAMPLE 2

A heavy polyester woven material was treated according to Example 1 with the differences that the rate of passage in the relaxed-state web treatment chamber was 10 meters per minute while a temperature of 150° C. was set in the flow-through reversible drum. The shrinkage amounted to 35%, the residual crimping value was, as in Example 1, plus or minus one.

EXAMPLE 3

Fellimitation was steamed in the relaxed-state treatment chamber. The lead amounted to 15 meters while the rate of passage was 11 meters per minute. The material was subsequently introduced directly into the flow-through reversible drum and finished at 135° C. effecting a lamb-skin effect.

EXAMPLE 4

A dry-high curled pile material was steamed in the tensioned-state web treatment apparatus while travelling at a rate of passage of 9 meters per minute and subsequently dried in the flow-through reversible drum at 150° C. The material exhibited, after treatment, upright curls which when subsequently cut established a pile of uniform height.

EXAMPLE 5

A high curled pile material according to Example 4 was soaked (wetted in a centrifuge) and then predried in the tensioned-state web treatment apparatus. The rate of passage was 8 meters per minute. A residual moisture of 40% was achieved. The material was then further treated in the flow-through reversible drum at 150° C. The crimping value amounted to 14%.

EXAMPLE 6

A tufted carpet material was steamed in the relaxed-state web treatment chamber. The lead amounted to 15 meters while the rate of passage was adjusted to 10 meters per minute. The treatment of the material was then continued in the flow-through reversible drum at 140° C. The material exhibited a largely equalized pile surface, produced by the opening of the individual threads of the carpet.

EXAMPLE 7

Reactive dyestuffs were padded upon a woven cotton material. The material was predried in the tensioned-state to approximately 50% moisture content. The rate of passage through the tensioned-state web treatment apparatus was 10 meters per minute. To increase the dyestuff yield, the material was slightly re-steamed in the relaxed-state web treatment chamber and introduced into the flow-through reversible drum. There the dyestuff was fixed at about 100° C. at constant moisture, the material then being advanced for further treatment.

EXAMPLE 8

A polyurethane artificial leather was pre-steamed in the tensioned-state and treated with hot air. The rate of passage amounted to 20 meters per minute. The material was subsequently irradiated in an infrared field and then fixed in the flow-through drum and grained at 135° C.

DESCRIPTION OF THE PREFERRED EMBODIMENTS

Figure 1:
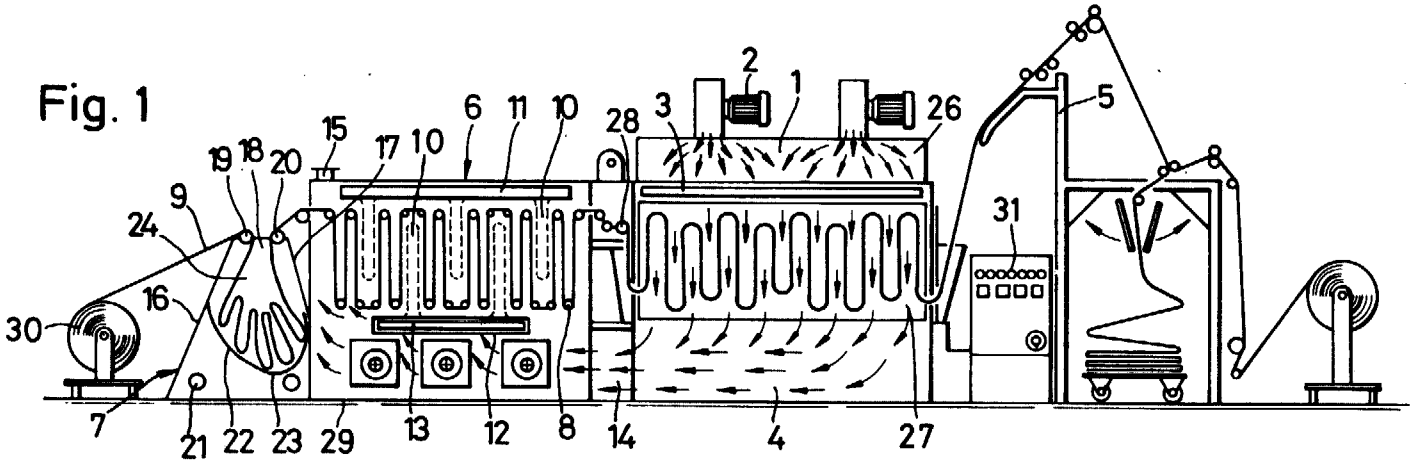
FIG. 1 illustrates an apparatus for treating a web of material of indefinite length according to this invention including a web supply means, a relaxed-state web treatment chamber, a tensioned-state web treatment chamber, a flow-through reversible drum, and a web demand means.
Figure 2:
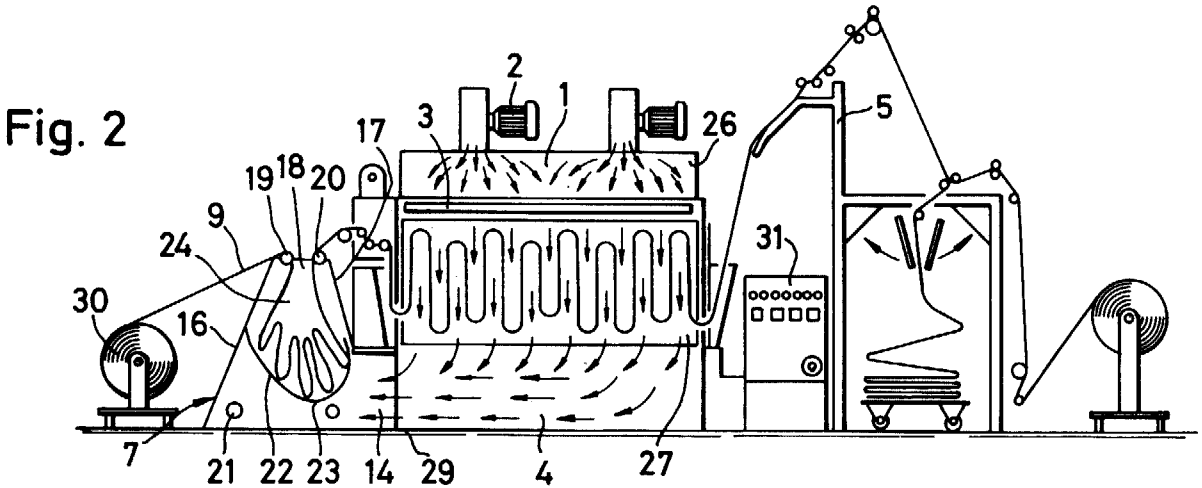
FIG. 2 illustrates another apparatus for treating a web of material of indefinite length according to this invention similar to that of FIG. 1 except excluding the tension-state web treatment chamber.
Figure 4:
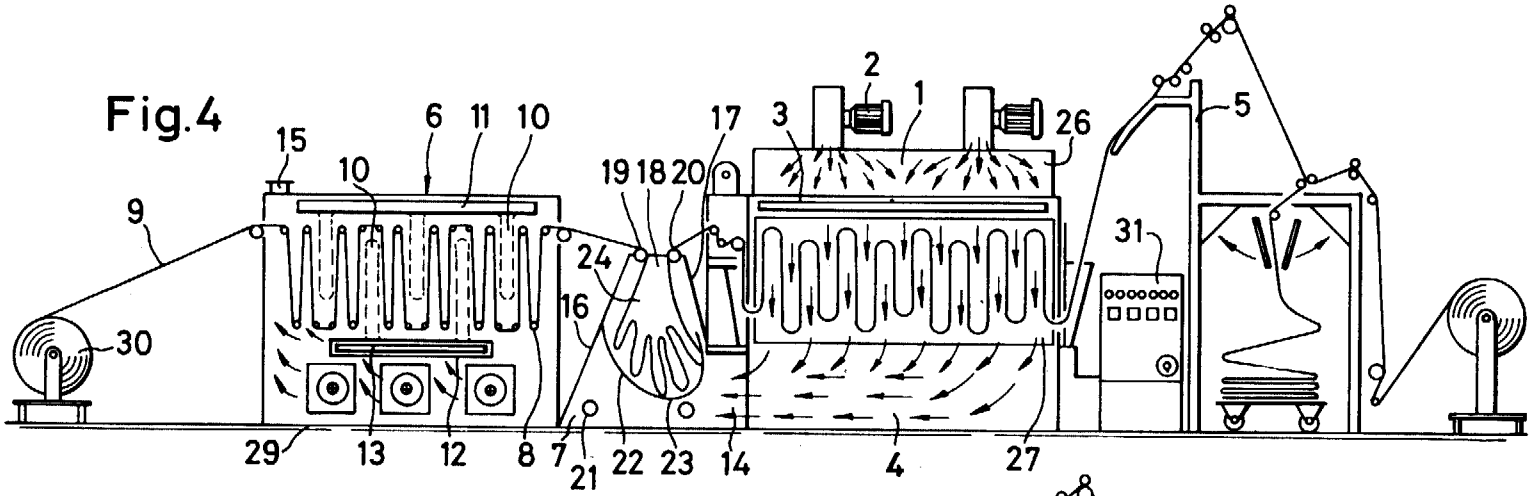
FIG. 4 illustrates an embodiment of an apparatus for treating a web of material of indefinite length according to this invention similar to that of FIG. 1 except that the relaxed-state web treatment chamber and the tensioned-state web treatment chamber are positioned in reverse order.
Figure 3:
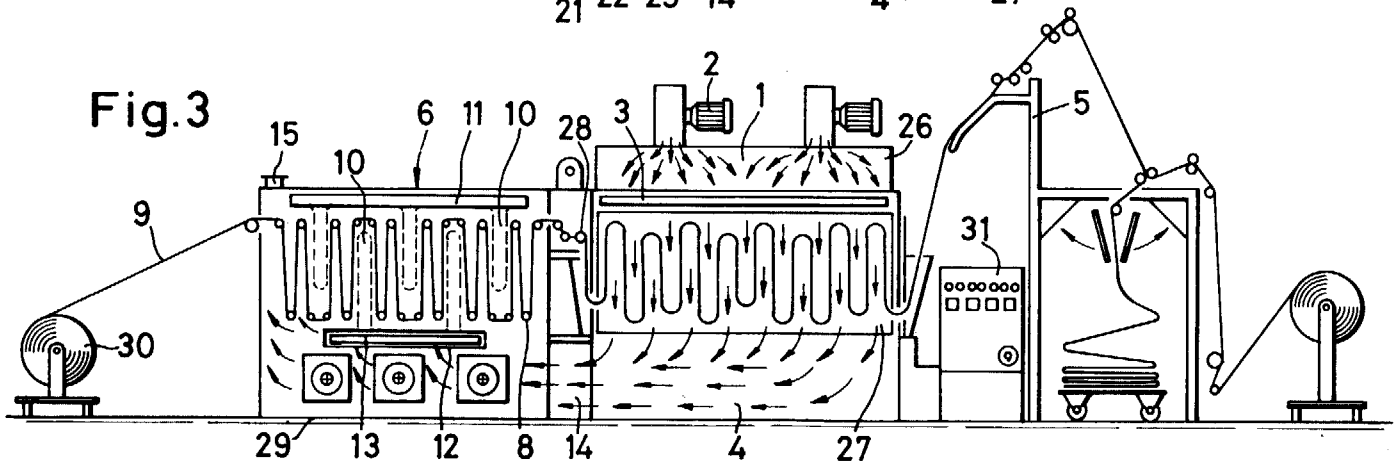
FIG. 3 illustrates an apparatus for treating a web of material of indefinite length according to this invention similar to that of FIG. 1 except excluding the relaxed-state web treatment chamber.
Figure 5:
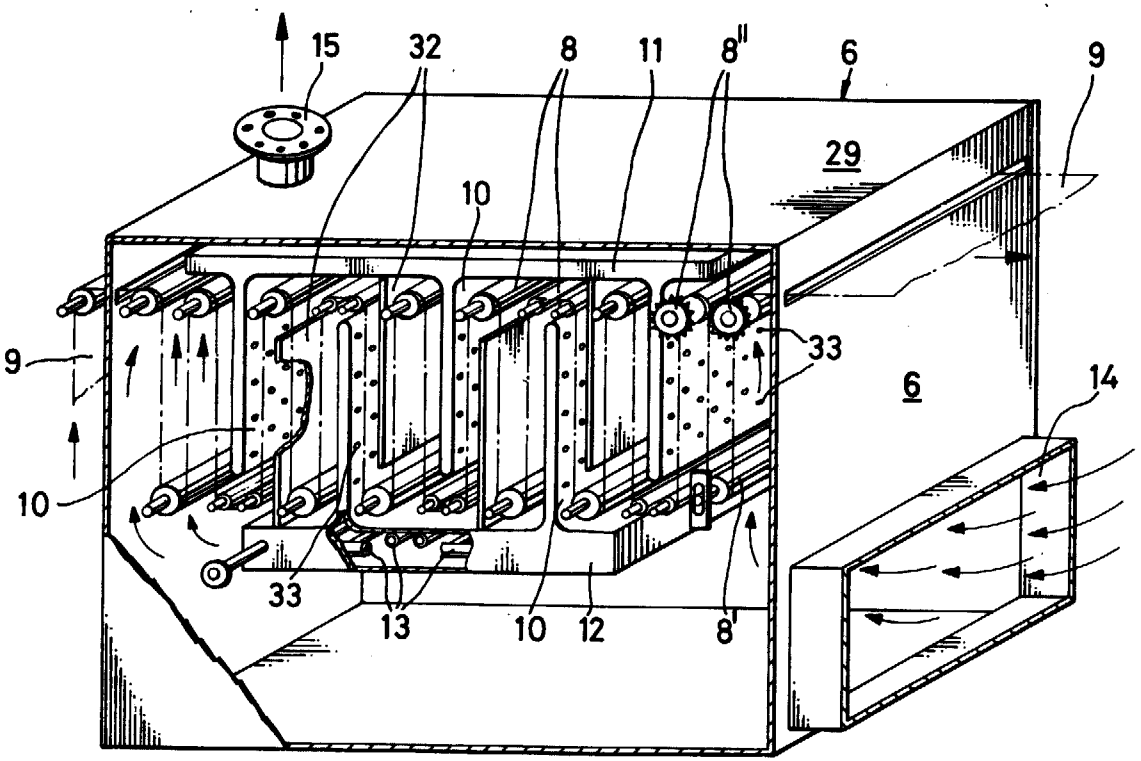
FIG. 5 is a perspective view of a preferred emmbodiment of the tensioned-state web treatment apparatus according to this invention shown partially in section.
Figure 6:
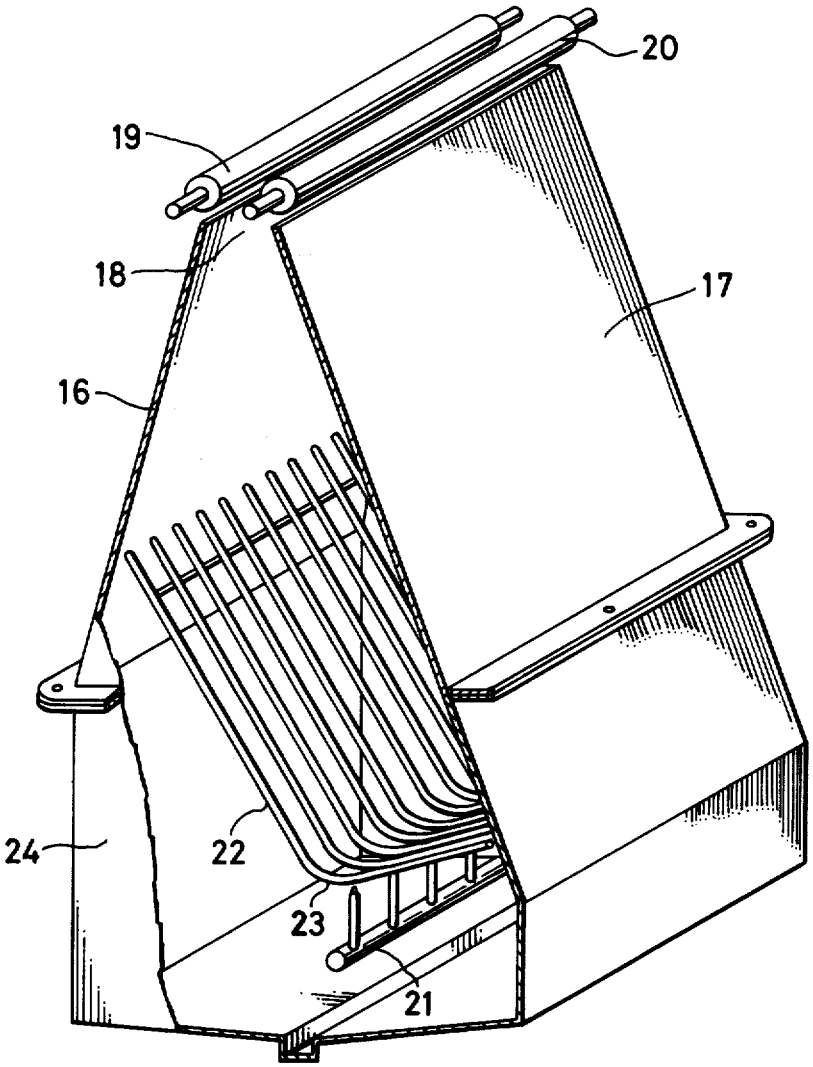
FIG. 6 is a perspective view of a preferred embodiment of the relaxed-state web treatment apparatus according to this invention shown partially in section.

Each of the analogous portions of the several arrangements of apparatus illustrated in FIGS. 1 through 6 are referred to by common numerals to indicate common portions of the apparatus. The apparatus illustrated in FIG. 1 is of particular utility in carrying out the process of Examples 1 and 2 but may also be used to carry out the process of Examples 4, 5, 6 and 8. The apparatus of FIG. 2 is particularly useful in carrying out the process of Examples 3 and 6 while the apparatus of FIG. 3 is particularly useful in carrying out the process of Examples 4, 5 and 8. The apparatus illustrated in FIG. 4 is particularly useful in carrying out the process of Example 7 but may also be used to perform the processes of Examples 3 through 8.

A central portion of the apparatus illustrated in the figures is a flow-through reversible drum treatment apparatus 1. The flow-through drum apparatus 1, described in more detail in copending application Ser. No. 400,911 now U.S. Pat. No. 3,938,356 filed Sept. 26, 1973, comprises generally a casing 26 having a drum 27 mounted for rotation within the casing 26. The apparatus 1 can include means 28 for introducing a web of material into the drum 27, the web 9 travelling continuously through the interior of the drum 27. The web is subsequently withdrawn from the drum 27 by a web demand means 5 for receiving the web from the apparatus 1 and depositing the web in an easily handled form. The apparatus 1 includes means 2 such as pressure ventilators for introducing air into the drum and conditioning means 3 such as heating registers for controllably conditioning the air introduced into the drum. The apparatus 1 also contains an air-outlet conduit means for permitting the escape of partially spend air having once contacted the web within the drum 27.

Preceding the flow-through reversible drum apparatus 1 is a tensioned-state web treatment apparatus 6 and/or a relaxed-state web treatment apparatus 7.

The tensioned-state web treatment apparatus 6 comprises a generally rectangular casing 29 enclosing a chamber in which is fixed a plurality of upper and lower rollers 8, 8' arranged within the casing 29 such that a web of material 9 traversing the apparatus 6 passes around the rollers 8, 8' in a vertical zig-zag path of loops. An upper distributor 11 and a lower distributor 12 is positioned within the apparatus 6 to distribute diverse treatment media such as steam and/or hot air to preselected regions of the apparatus. Duct means 10 standing upon and depending from the upper and lower distributing means 11 and 12 respectively project into selected loops in the zig-zag path of the web of material and direct the diverse treatment media on preselected portions of the web. The lower distributor 12 can be provided with a heating means 13 for additionally supplying selected amounts of heat. The lower distributor 12 can also be connected to the air outlet conduit 4 of apparatus 1 by way of a pipe connection 14 while spent air can escape the apparatus 6 by way of aperture 15. The upper distributor 11 can be connected selectively to an external hot air supply and to a steam pipe (not shown) so that the web 9 cannot only be dried but possible also be steamed while in the tensioned-state.

Preferably some of the upper and lower rollers are constructed as flattening rollers with a special corrugation which extends from the middle of the roller toward the ends as illustrated in U.S. Pat. No. 3,805,560. Preferably the rollers having the special corrugation also have a smaller cross-section than the rest of the rollers. The flattening rollers are then driven with a higher angular velocity whereby the flattening effect increases. The velocity of the rollers 8, 8' is determined by the size of the roller drive means 8" in conjunction with the control means 31.

The relaxed-state web treatment apparatus 7 comprises a front wall 16 and a rear wall 17 which are preferably inclined toward each other at the top thus forming a gap 18. Means 19 for introducing the web 9 of material into the chamber through the gap 18 and means 20 for withdrawing the web of material from the chamber through the gap 18 are positioned near the top of the front wall 16 and rear wall 17, respectively. In the bottom portion of the apparatus 7 are found one or more means 21 for introducing a web treatment medium such as steam into the apparatus. A screen or grate 22 is arranged within the apparatus 7 to asymmetrically sag, the deepest point 23 of the screen being preferably positioned closer to rear wall 17 than to front wall 16. The apparatus 7 further comprises side walls 24 such that the only opening for introduction or withdrawal of the web of material is gap 18.

In operation a web supply means 30 supplies a web of material 9 of indefinite length to be variously treated according to this invention depending on what kind of material is to be treated and what effect is to be produced.

When the relaxed-state web treatment apparatus 7 is employed, the web of material 9 is drawn into the apparatus 7 by draw-in roller 19 by way of gap 18 and is deposited on screen 22 in loops which slide, on account of the screen inclination, to the deepest point 23. The weight of the material compresses the loops which in each case precede it, and lifts them on the succeeding portion of the screenn up to a level determined by the amount of material lead. The web of material is then drawn off by way of draw-off roller 20. Since the rate of passage of the material is controlled by any succeeding devices as well as by control means 31 for controlling the operation of the various elements of the apparatus, the period of dwell in the relaxed-state treatment chamber depends on the length of web introduced into the chamber 7 before starting to draw off the web.

It must be recognized that the fabric typically treated by the web treatment apparatus of this class is not a homogenous material and is in fact occasionally a very delicate material. Even slight variations of moisture content from point to point can result in an uneven width or in bagging of the web of fabric. Each individual fiber should ideally have the same moisture content and be dried at the same time and speed as all others. Water droplets falling on the web of fabric often are very visible after drying. To avoid this, the web of material 9 is itself kept from contacting the walls 16 and 17 and is supported within the chamber on the screen or grate 22. For this reason the gap 18 is located near the middle axis of the chamber. Further, the walls 16 and 17 are preferably inclined in order to form the gap 18 at such an angle as would prevent condensation from dripping upon the material placed within the chamber 7 but would allow the condensation to run down the walls 16 and 17.

In the tensioned-state web treatment apparatus 6 the material web is advanced by the driven rollers 8 in the tensioned and flattened state. The rollers 8 are in this process driven synchronously and controlled by control means 31. Depending on the manner in which pipes 10 are combined into groups, the material can be steamed or treated with hot air or with both treatment media successively or simultaneously. From the zig-zag guidance of the material results a compact structure of the apparatus which nevertheless insures a period of dwell within the apparatus 6 sufficient for the setting of the moisture content of the material.

In the tensioned-state web treatment apparatus 6 there are three separate currents of air for web treatment which must be considered: first, discharged from the jets or holes 33 found distributed uniformly over the surface of the duct means 10 which is attached to the upper distributor 11, a second discharge from the jets 33 in the duct means 10 attached to the lower distributor means 12, and thirdly the previously treated air entering through inlet 14. It is preferably that each current is kept in contact with the web of fabric 9 as long as possible following the web in its vertical zig-zag path of loops such that both fabric sides are subjected to the desired treatment. To help achieve this end, leading plates 32 are placed between selected loops of the zig-zag path. The leading plates 32 can be supported by attachment to either the upper or lower distributors 11 and 12 or to the walls of the casing 29.

The treatment of the material is typically completed in the flow-through reversible drum treatment apparatus 1 at increased temperatures and possibly additional irradiation, etc. The temperature, irradiation, speed of rotation of the drum and periodicity of reversal of rotation of the drum can be controlled by control means 31. The web 9 departs from the flow-through drum apparatus in the form of a strand which is then flattened by the web demand means 5 and deposited in an easily handled form. The web of material can also be passed onto further web treatment apparatus now shown.

The principal difference between apparatus 6 and apparatus 7 lies in the difference between treating a material while in a relaxed-state or in a tensioned-state. The shrinking of material when subjected to steaming within apparatus 7 takes place unimpededly while in apparatus 6 the shrinking is prevented or at least reduced by the tensioned-state of the material. In the treatment of materials such as polyester, acrylic, and the like, substantial shrinking up to 30% can be observed under these circumstances which shrinking must be taken into consideration by the setting of the different roller speeds along the apparatus by control means 31. The treatment of the material in the flow-through drum apparatus 1 completes and stops the previously initiated shrinking. The apparatus then provides a uniform control of the process permitting the operator to fix a given material in any desired finished state. Many effects, not only shrinking, are obtainable with the apparatus according to this invention as is evident from the foregoing examples and as will be appreciated by those having skill in the art.

Although the invention has been described in considerable detail with reference to certain preferred embodiments thereof and with examples of the operation, it will be understood that variations and modifications can be effected within the spirit and scope of the invention as described above and as defined in the appended claims.

What is claimed is:

1. An apparatus for treating a web of material of indefinite length comprising a combination of, a web supply means for supplying a web of material of indefinite length, a relaxed-state web treatment chamber comprising a base, a front wall, a rear wall and a pair of side walls fixed to the base and to each other enclosing a chamber open at a gap in the top existing between the front and rear walls, a screen arranged within the chamber to asymmetrically sag in a shape of approximately elliptical cross-section, means for introducing the web of material from the web supply means into the chamber through the gap, means for introducing a web treatment medium into the chamber and means for withdrawing the web of material from the chamber through the gap, a flow-through reversible drum treatment chamber comprising a casing, a drum mounted for rotation within the casing, means for introducing the web received from the relaxed-state web treatment chamber into the drum, the web travelling continuously through the interior of the drum, conditioning means for controllably conditioning air and introducing the air into the drum and casing and means for withdrawing the web from the drum and casing, and web demand means for receiving the web from the flow-through reversible drum treatment chamber and depositing the web in a easily handled form.

2. The apparatus of claim 1 further comprising a tensioned-state web treatment chamber comprising a generally rectangular casing enclosing a chamber, a plurality of upper rollers and a plurality of lower rollers arranged within the casing such that a web of material traversing the chamber passes around the rollers in a vertical zig-zag path of loops, upper and lower distributor means positioned with the chamber for distributing diverse treatment media to preselected regions of the chamber, and duct means standing upon and depending from the upper and lower distributor means respectively and projecting into selected loops in the zig-zag path of the web of material for directing the diverse treatment media on preselected portions of the web.

3. An apparatus for treating a web of material of indefinite length comprising a combination of, a web supply means for supplying a web of material of indefinite length, a tensioned-state web treatment chamber comprising a generally rectangular casing enclosing a chamber, a plurality of upper rollers and a plurality of lower rollers arranged within the casing such that a web of material traversing the chamber passes around the rollers in a vertical zig-zag path of loops, upper and lower distributor means positioned with the chamber for distributing diverse treatment media to preselected regions of the chamber, and duct means standing upon and depending from the upper and lower distributor means respectively and projecting into selected loops in the zig-zag path of the web of material for directing the diverse treatment media on preselected portions of the web, a flow-through reversible drum treatment chamber comprising a casing, a drum mounted for rotation within the casing, means for introducing the web received from the tensioned-state web treatment chamber into the drum, the web travelling continuously through the interior of the drum, conditioning means for controllably conditioning air and introducing the air into the drum and casing and means for withdrawing the web from the drum and casing, and web demand means for receiving the web from the flow-through reversible drum treatment chamber and depositing the web in an easily handled form.

* * * * *